US006457653B1

(12) United States Patent
Campbell

(10) Patent No.: US 6,457,653 B1
(45) Date of Patent: Oct. 1, 2002

(54) BLOWERLESS AIR CONDITIONING SYSTEM

(75) Inventor: Bradley J. Campbell, Chesterfield, MO (US)

(73) Assignee: Nordyne, Inc., O'Fallon, MO (US)

( * ) Notice: Subject to any disclaimer, the term of this patent is extended or adjusted under 35 U.S.C. 154(b) by 0 days.

(21) Appl. No.: 09/790,400

(22) Filed: Feb. 21, 2001

(51) Int. Cl.[7] ..... F24F 7/06

(52) U.S. Cl. ..... 236/49.3; 62/298; 165/48.1; 236/91 D

(58) Field of Search ..... 62/77, 259.1, 263, 62/298; 165/48.1; 236/49.3

(56) References Cited

U.S. PATENT DOCUMENTS

| | | | | |
|---|---|---|---|---|
| 2,559,821 A | | 7/1951 | Kagan | |
| 2,797,559 A | | 7/1957 | Atchison | |
| 2,804,816 A | | 9/1957 | Hoyer | |
| 2,892,324 A | | 6/1959 | Quick | |
| 4,018,266 A | * | 4/1977 | Kay | 165/48.1 |
| 4,362,091 A | * | 12/1982 | Cox | 62/314 |
| 4,505,328 A | | 3/1985 | Schmitt | |
| 4,776,385 A | * | 10/1988 | Dean | 236/49.3 |
| 4,874,038 A | * | 10/1989 | Ehlert | 62/259.1 |
| 5,277,036 A | * | 1/1994 | Dieckmann et al. | 62/298 |
| 5,284,027 A | * | 2/1994 | Martin, Sr. | 62/298 |
| 5,740,790 A | | 4/1998 | Lipsky | |
| 5,927,096 A | * | 7/1999 | Piccione | 62/298 |

OTHER PUBLICATIONS

Installation Instructions, Automatic Damper No. 901083, Nordyne, Inc.

Installation Instructions, Automatic Shut–off Damper Model 902095, Nordyne, Inc.

Installation Instructions, Automatic Damper Kit, Part #901996, Nordyne, Inc.

Installation Instructions, Evaporator Blower Air Handlers Models EB–36, 30, & 24, pp. 1–7, International Oil Buner.

Whatever the Installation Requirement, There's An International Weatherite Air Conditioning System To Do The Job, International Oil Burner Co.

Exploded Parts Diagram for EFT–36, Sep. 1, 1970, International Oil Burner Co.

Exploded Parts Diagram for EFT–40, Sep. 1, 1970, International Oil Burner Co.

Exploded Parts Diagram for EB 24, 30 & 36 Air Handlers, Dec. 15, 1969, International Oil Burner Co.

Declaration of William Sterner, dated May 3, 2002.

Declaration of Bradley Campbell, dated May 15, 2002.

* cited by examiner

*Primary Examiner*—William E. Tapolcai
(74) *Attorney, Agent, or Firm*—Cesari and McKenna, LLP; Michael R. Reinemann

(57) ABSTRACT

A blowerless air conditioning or heat pump system for use in providing conditioned air includes an outdoor section that is preferably coupled to an indoor section, and is advantageously used with a forced hot air furnace and a corresponding air distribution duct system of a home or building. The two sections are preferably installed along a boundary of the home or building such that outdoor section is outside of the home and the indoor section is inside or below the home and proximate to a forced hot air furnace. Disposed within the outdoor unit are a compressor, an outdoor coil and an outdoor fan. Disposed within the indoor section is an evaporator coil. There is no separate fan or blower disposed within the indoor section. An inlet air tube couples the indoor section to a first point in the air distribution system, and an outlet air tube couples the indoor section to a second point in the air distribution system. The second point is downstream of the first point relative to the furnace. If needed, a dam may be positioned between the two points in the air distribution system to divert air from the furnace through the system.

27 Claims, 7 Drawing Sheets

BLOWERLESS AIR CONDITIONING SYSTEM

BACKGROUND OF THE INVENTION

1. Field of the Invention

The present invention is directed to air conditioning systems, and more specifically, to a blowerless air conditioning or heat pump system.

2. Background Information

Many homes, especially mobile or manufactured homes, include a forced hot air furnace for heating the home. A common type of forced hot air furnace is a down-flow furnace, in which a burner generates hot combustion gases and forces them to flow upwardly through a heat exchanger. A blower is typically disposed above the heat exchanger to draw room air into the furnace and force it downwardly past the heat exchanger. As this room air flows past the heat exchanger, it is heated. This heated air typically exits at the bottom of the furnace which is coupled to a series of ducts extending from the furnace to the various rooms of the home. The blower is powerful enough to drive air not only past the heat exchanger, but also through these ducts and into the rooms being heated.

Another common type of furnace is an electric furnace. A blower is typically disposed above one or more electric heat elements within the furnace. The blower draws room air into the furnace and forces it downwardly past the elements. As in the fossil fuel furnace, the air is heated and the blower is powerful enough to drive the air through the ducts to the various rooms of the home.

It is often desirable to add air conditioning to these homes, usually at the time the home is installed. Most air conditioners have two main components: an evaporator coil which is installed with the furnace, and a condensing unit which is located outside of the home. The evaporator coil and condensing unit are connected together by a pair of copper pipes in which the system's refrigerant flows. The condensing unit typically includes a compressor or pump, a condenser coil and an outdoor fan and motor combination. The evaporator coil is typically connected to the home's air distribution ducts that lead to the various rooms being conditioned. When cooling is desired, liquid refrigerant is pumped through to the evaporator coil where it evaporates absorbing heat from the air being blown over the evaporator coil by the fan and motor in the furnace. This cooled air is then forced through the ducts and into the rooms. Evaporated refrigerant flows to the compressor where it is compressed. Hot, high pressure gas exiting the compressor is then pumped through the condenser coil where it is cooled by the air being forced through the condenser coil by the outdoor fan, causing the refrigerant to condense back into a liquid. The liquid then flows to the evaporator coil through an expansion device which dramatically lowers its pressure. The refrigerant is now very cold and flows through the evaporator coil completing the cycle.

The air conditioning system may also be formed as a single package unit containing both the evaporator coil and the condensing unit. A package air conditioning system also includes a blower and duct connections which are tied to the home's duct system. This type of package system is typically mounted outdoors and is used in conjunction with a damper which prevents the cooled air generated by the system from entering the furnace already installed in the home.

U.S. Pat. No. 5,740,790 describes a typical type of air conditioning system, which is made as an add-on to the down-flow furnace described above. Here, the furnace is raised and an enclosure is mounted underneath the furnace between the heat exchanger and the feeder duct which leads to the home's air distribution ducting system. Disposed in this new enclosure is the evaporator coil of the air conditioner. To provide air conditioning, the furnace's blower is activated, but not its burner. The blower forces air past the evaporator coil in the enclosure and into the air distribution duct system. Pressurized liquid refrigerant is supplied to the evaporator coil from a condensing unit. The refrigerant evaporates within the evaporator coil extracting heat from the air. This cooled air then flows through the air distribution duct system and into the rooms of the home.

In electric furnace systems, the air conditioning evaporator coil is typically added on top of the furnace. As in the fossil fuel furnace, the blower runs with the electric heat elements off to force room air to be cooled through the evaporator coil.

Although quite popular, air conditioning systems, such as those described above, especially the combined or split systems, can be relatively expensive due to the number of required components and difficult to install. Accordingly, many individuals wishing to obtain air conditioning for their homes simply cannot afford the costs of the system.

The system described in the U.S. Pat. No. 5,740,790 has several disadvantages. For example, it requires the existing furnace to be raised, requiring additional space within the home in order for the enclosure to be installed. For many furnace installations, it is not possible to raise the furnace due to its location in the home, thereby precluding this type of air conditioner. The air conditioning unit must also be designed with the particular furnace in mind since it mounts directly to the furnace. In addition, due to the location of the evaporator coil, condensate forming on the coil may enter the home or heating system causing water damage.

Also, a set of copper tubes, must be run from the evaporator coil to the condensing unit. These tubes are susceptible to leaks and damage which generally cause the air conditioning unit to fail, and which may also result in environmental damage.

The package system described above also has several disadvantages. The system requires a damper to be installed underneath the existing furnace. Further, the home now has two blowers (one in the furnace and one in the package unit), which adds cost to the overall system.

SUMMARY OF THE INVENTION

It is an object of the present invention to provide an economical air conditioning or heat pump system that can be installed regardless of the type of forced hot air furnace being used.

It is a further object of the present invention to reduce labor costs involved in the installation of an air conditioning system.

It is a still further object of the present invention, to reduce the number of components required by the air conditioning system.

Briefly, the invention relates to a blowerless air conditioning or heat pump system for providing conditioned (e.g., heated, cooled and/or dehumidified) air. The system includes an outdoor section that is joined to an indoor section, and is advantageously used with a preexisting air moving system, such as a forced hot air furnace, and a corresponding air distribution duct system. The two sections are preferably installed along a boundary of the space being cooled (e.g., along a skirt or exterior wall of a home) such that the outdoor section is outside of the home and the indoor section is inside or below the home and proximate to a forced hot air furnace. Disposed within the outdoor section are a compressor, an outdoor coil and an outdoor fan. Disposed within the indoor section is an evaporator coil. In accordance with the invention, there is no separate fan or blower disposed within the indoor section. The system further includes an inlet air conduit that couples the indoor section to a first point in the air distribution system, and an outlet air conduit that couples the indoor section to a second point in the air distribution system. The second point is downstream of the first point relative to the furnace. The system may also include a dam that is positioned between the two points in the air distribution system.

In operation, the compressor compresses a refrigerant and pumps it to the outdoor coil within the outdoor section where it is cooled and liquefied. Liquid refrigerant flows through an expansion device substantially lowering its pressure and enters the evaporator coil within the indoor section. The blower (but not the burner or electric heating elements) within the furnace is also activated, thereby forcing air through the furnace and into the air distribution system. By virtue of the dam, the air is diverted through the inlet conduit, into the indoor section and through the evaporator coil. As refrigerant flows through the evaporator coil, it evaporates, thereby absorbing heat and/or humidity from the air flowing into the indoor section. This "conditioned" air is then returned to air distribution duct system by the outlet conduit, where it can be distributed throughout the home. The refrigerant from the evaporator coil, is conveyed to the compressor thereby completing the cycle. This process is repeated as long as conditioned air is being requested within the home.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
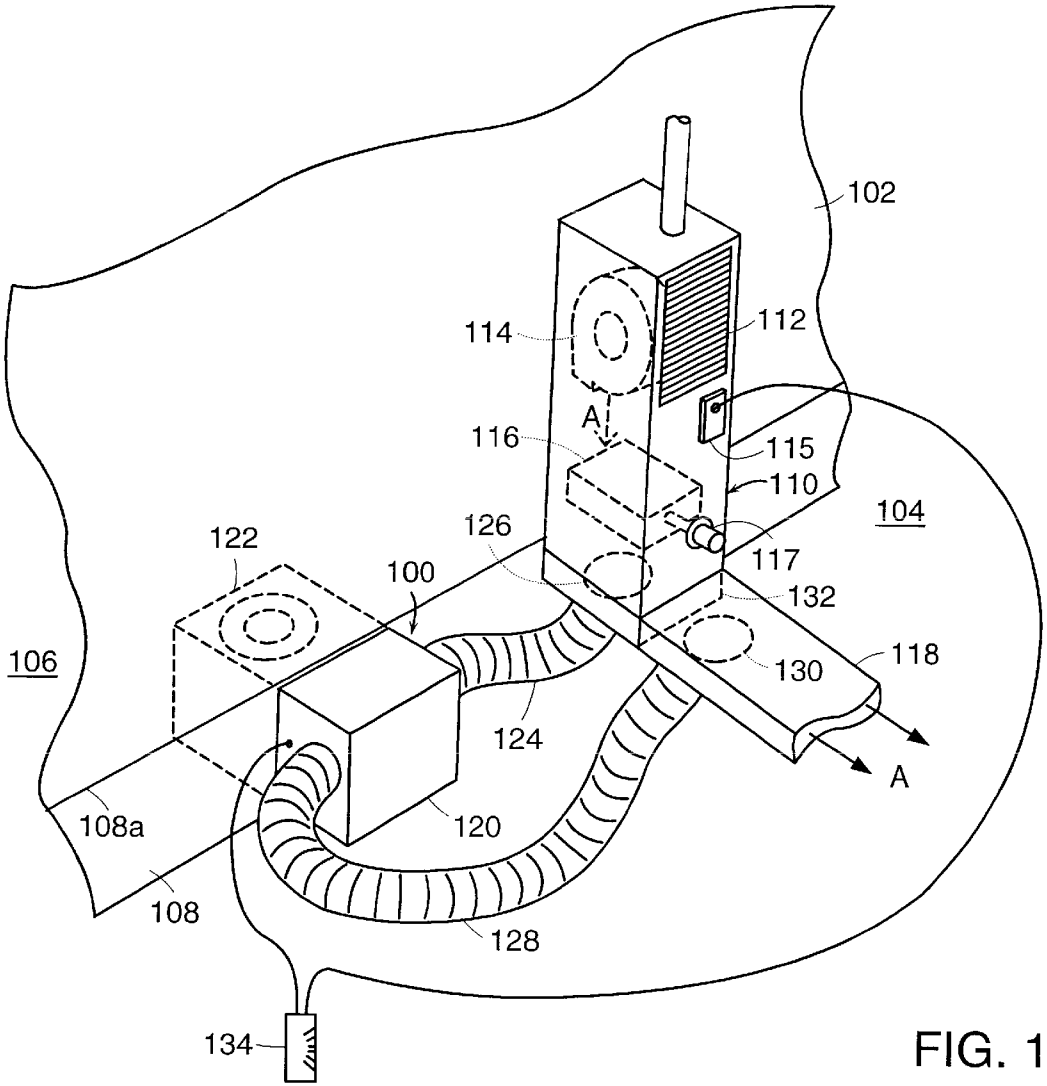
FIG. 1 is an isometric view of the air conditioning system of the present invention as installed in a home.

FIG. 1 is a partial view of a home in which a blowerless air conditioning system 100 in accordance with the present invention has been installed. The home includes at least one exterior wall 102, thereby defining an interior space 104 and an exterior space 106. The wall 102 may also include a skirt or foundation 108 which extends along a lower portion thereof. An upper edge 108*a* of skirt 108 may generally define the floor of the home. Within the interior 104 of the home is an air moving system, such as a forced hot air furnace 110. The furnace 110 preferably includes at least one inlet 112, which may be a louvered door, allowing room air to enter the furnace 110. Disposed within the furnace 110 is a circulation blower 114, a heat exchanger 116, and a burner 117, a portion of which may extend into the heat exchanger 116. A furnace controller 115 is operably connected to the circulation blower 114 and burner 117. Also located within the interior 104 of the home is an air distribution duct system 118. The air distribution duct system 118 may comprise a series of interconnected ducts leading to the various rooms of the home. The furnace 110 is preferably coupled to the air distribution duct system 118 so that room air, drawn into the furnace 110 and heated by the heat exchanger 116, may be distributed to the various rooms under the operation of the circulation blower 114.

The blowerless system 100 has an indoor unit or section 120 and an outdoor unit or section 122 that are joined together. The system 100 is preferably installed at exterior wall 102 so that outdoor section 122 is disposed in exterior space 106 (e.g., outside the home or building), while the indoor section 120 is disposed within the interior space 104 (e.g., inside or underneath the home or building). That is, a hole or passageway is preferably cut into the skirt or foundation 108. The system 100 is then mounted within this hole, such that indoor section 120 is beneath the floor line 108*a*. Preferably, the system 100 is mounted in proximity to the furnace 110, e.g., between approximately 1 to 15 feet, although it could be further away. A first auxiliary conduit or inlet 124 preferably couples the indoor section 120 of the system 100 to a first point 126 of the air distribution duct system 118. A second auxiliary conduit or outlet 128 couples the indoor section 120 to a second point 130 of the air distribution duct system 118. In accordance with the invention, the second connection point 130 is located downstream from the first connection point 126 relative to the direction of air as it flows from the furnace 110 and through the air distribution duct system 118 as shown by arrows A. Disposed within the air distribution duct system 118 between the two connection points 126, 130 is a dam or baffle 132. The dam or baffle 132 is preferably a solid panel that blocks air from flowing through duct system 118 between the two connection points 126, 130.

Disposed within the home is a thermostat 134. The thermostat 134 preferably includes both heating and cooling modes that can be individually selected by the home-owner as well as an adjustable temperature selector.

Figure 2:
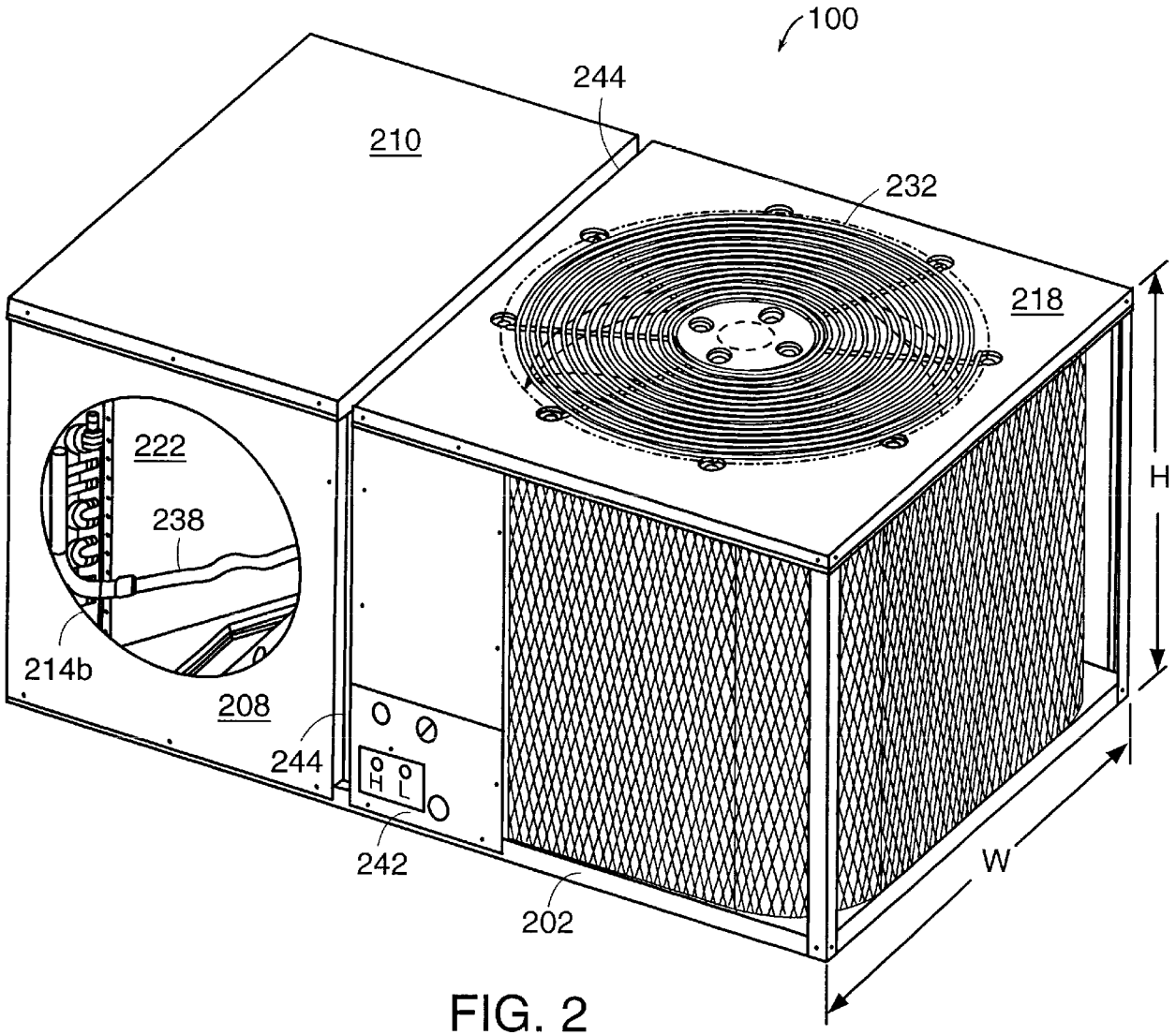
FIG. 2 is an isometric view on a larger scale of the air conditioning system of FIG. 1.
Figure 3:
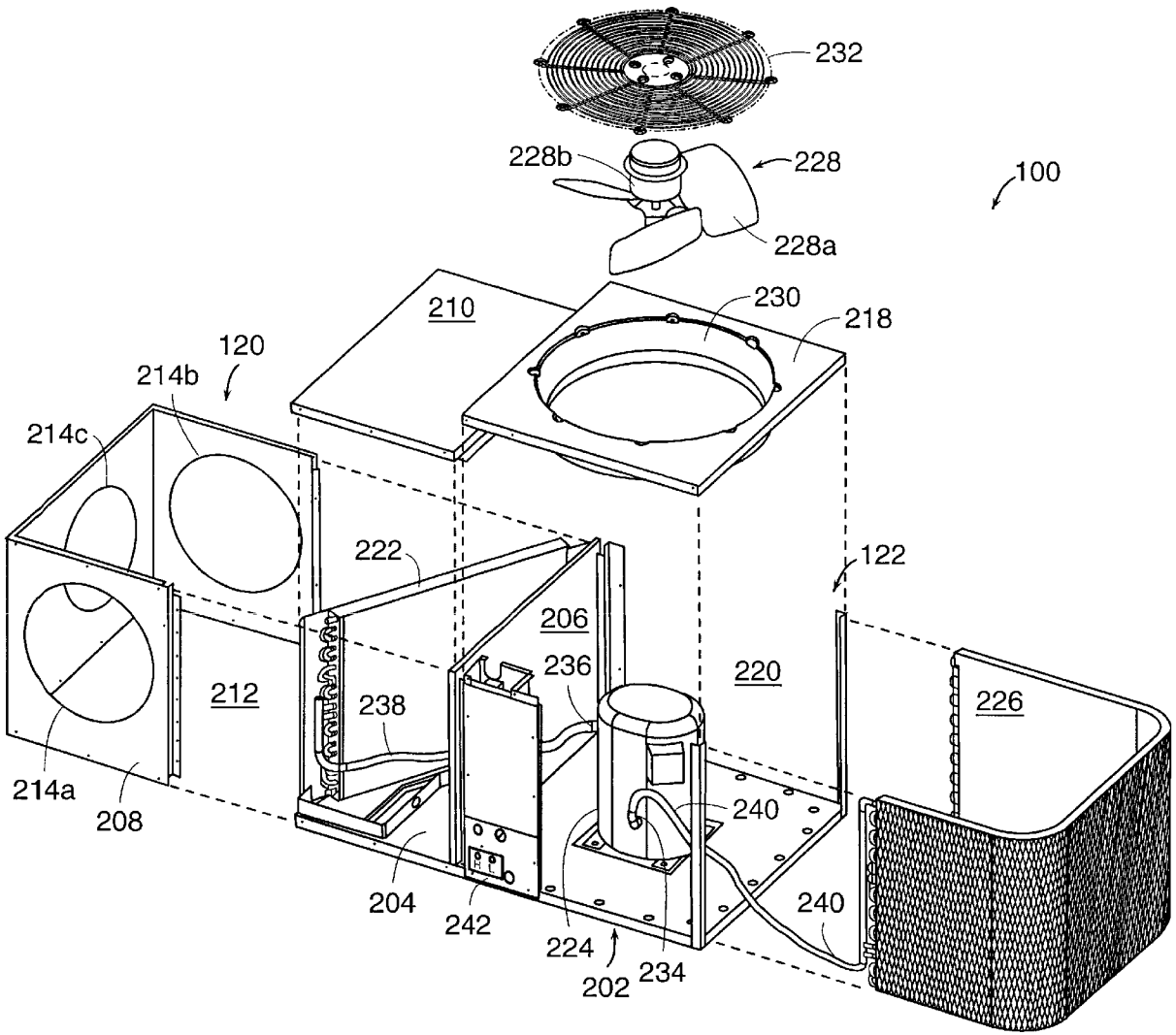
FIG. 3 is an exploded isometric view of the air conditioning system showing the internal components of the system in greater detail.

FIG. 2 is an isometric view of the air conditioning system 100 and FIG. 3 is an isometric, exploded view of the system 100. As shown in FIGS. 2 and 3, the system 100 preferably includes an integrated support structure 202 including a base 204 and an intermediary wall 206 that separates the two sections 120, 122. The indoor section 120 has a three-sided outer wall 208 and a cover 210 which cooperate with the base 204 and intermediary wall 206 to define a generally enclosed evaporator space 212. Formed within three sides of outer wall 208 are corresponding holes 214*a*, 214*b* and 214*c*. Preferably, the holes 214*a*, 214*b*, 214*c* are each formed in a respective side of outer wall 208. The outdoor section 122 includes a condensing coil 226 and cover 218 that define a compressor space 220 within outdoor section 122. Mounted to the base 204 within the evaporator space 212 is an evaporator coil 222. The evaporator coil 222 may be mounted to base 204 along one of its sides and may extend diagonally within the space 212 so as to maximize its length and increase the coil surface area facing the holes 214*a*, 214*b*, and 214*c*. The evaporator coil 222 may be mounted by any suitable means, e.g., screws, nuts and bolts, rivets, or other fasteners. Built into the inlet of the evaporator coil 222 is an expansion or metering device (not shown).

Mounted to the base 204 within the compressor space 220 is a compressor 224. Mounted to the cover 218 of the outdoor section 122 is an outdoor fan 228. The fan 228 preferably includes a propeller 228*a* and an electric motor 228*b* for driving the propeller 228*a*. A grill 232 may be mounted to cover over a hole 230 formed within the cover 218 and the fan 228 may be fastened to the grill 232.

The compressor 224 has an inlet 236 for receiving a refrigerant substantially in a vapor phase, and an outlet 234 for supplying compressed refrigerant, also substantially in a vapor phase. The compressor outlet 234 is preferably coupled to the outdoor coil 226 so that compressed refrigerant can flow through the outdoor coil 226. For example, a first line 240 may extend from the compressor outlet 234 and connect to the outdoor coil 226. The evaporator coil 222 is coupled to the outdoor coil 226 so that liquid refrigerant can flow from the outdoor coil 226 and into the evaporator coil 222 through the expansion device. The evaporator coil 222 and outdoor coil 226 may be connected by one or more pipes that extend through the intermediary wall 206. A second tube 238 that passes through wall 206 couples the evaporator coil 222 to the compressor inlet 236.

A suitable fan for use with the present invention is the Model 5KCP29FCA283AS from General Electric. A suitable compressor is the Model CR34KF-PFV-230 from Copeland.

Suitable furnaces with which system 100 may be advantageously used include the M1 fossil fuel furnace and the E2 electric furnace which are commercially available from Nordyne, Inc. of St. Louis, Mo.

It should be understood, however, that the air moving system need not be a furnace. In particular, some homes, especially those in warmer climates, do not have a furnace at all. In this case, the air moving system may simply comprise a circulation blower, which is coupled to an air distribution duct system for circulating air through the home. With this embodiment, there is no provision for distributing heated air to the rooms of the home.

The system 100 may but need not further include a control unit or circuit 242 for activating and governing the operation of the compressor 224 and the fan 228. Those skilled in the art will appreciate that electrical power is preferably supplied to the control unit 242, fan 228 and compressor 224 by suitable means.

Leads from the thermostat 134 are preferably coupled to the burner 117 and the blower 114 of the furnace 110, and to the compressor 224 and outdoor fan 228 of the system 100. Alternatively, the thermostat 134 may be connected to the furnace controller 115 and to the air conditioning system controller 242, which are in turn connected to the burner 117, blower 114, compressor 224 and outdoor fan 228.

It should be understood that the compressor 224 may alternatively be mounted in the indoor section 120 or may even be disposed externally to the system 100.

In operation, the thermostat 134 (FIG. 1) is preferably set to the cooling mode and the temperature dial or lever is positioned at a level that is below the current room temperature, thereby generating a call for air conditioning. In response to this condition, the thermostat 134 is configured to transmit a signal to both the furnace 110 and to system 100. More specifically, the thermostat 134 activates the furnace blower 114, but not burner 117 (or, in the case of an electric furnace, the electric heating elements). Activation of the blower 114 causes room air to be drawn into the furnace 110 via louvered inlet 112 which air is forced down past the heat exchanger 116. Since the burner 117 is not running, however, the air is not heated. The un-heated air then enters the air distribution duct system 118 directly below the furnace 110. Due to the dam or baffle 132 that was mounted in the duct system 118, the air is blocked from simply flowing through the duct system 118 and entering the various rooms. Instead, the air is diverted into the first conduit 124. The air flows through the first conduit 124 and enters the indoor section 120 of the blowerless air conditioning system 100.

The thermostat 134 similarly activates the compressor 224 and the fan 228 of system 100. Refrigerant is thus compressed and pumped from the compressor 224 into the outdoor coil 226 via line 240. The refrigerant is cooled and liquefied, and the liquid refrigerant is conveyed to the evaporator coil 222 through the corresponding in-wall fittings. At the evaporator coil 222, the refrigerant is expanded substantially lowering its temperature, and this cold refrigerant flows through the evaporator coil 222. Un-heated room air diverted by dam 132 enters the evaporator space 212 of the system 100 by virtue of first conduit 124 and hole 214*a* in wall 208. The room air flows through the evaporator coil 222 causing it to be cooled and/or de-humidified by the refrigerant flowing is through evaporator coil 222. The cooled and/or de-humidified air exits the evaporator space 212 via hole 214*b* and/or 214*c* in wall 208 and enters the second conduit 128. From second conduit 128, the conditioned air returns to the air distribution duct system 118 at the second point 130. The presence of the dam or baffle 132 blocks the cooled and/or de-humidified air from flowing back into the furnace 110 or back into the system 100. Instead, the cooled and/or de-humidified air flows through the air distribution duct system 118 and enters the various rooms of the home.

The transfer of heat from room air to the compressed refrigerant within the evaporator space 212 of system 100, causes the refrigerant to evaporate. The vapor refrigerant exits the evaporator coil 222 and enters the compressor 224 via line 238 and inlet 236. The vapor refrigerant is compressed thereby raising its temperature and pressure. It is also pumped to outdoor coil 226. As described above, in addition to activating the compressor 224, the thermostat 134 also activates the fan 228. This causes outdoor air to be drawn through the outdoor coil 226 and into the compressor space 220. The air is then expelled from the compressor space 220 via hole 230 through operation of the fan 228. This flow of outdoor air causes the hot, high pressure refrigerant flowing through the outdoor coil 226 to condense, and the liquefied refrigerant is made available to the evaporator coil 222, thereby completing the cycle.

When the temperature at the thermostat 134 drops below the current setting, the thermostat 134 disables the call for air conditioning. More specifically, the thermostat 134 de-activates the furnace blower 114, thereby stopping the flow of room air into the furnace 110 and through the indoor section 122 of the system 100. The thermostat 134 also de-activates the compressor 224 and the fan 228, thereby stopping the flow of refrigerant through the system 100.

Alternatively, the thermostat 134 may issue a stop signal to the furnace controller 115 and the system controller 242, which respond as described above.

If the thermostat 134 is set to heating mode and the temperature at the thermostat 134 falls below the current setting, the thermostat 134 may issue a call for heat. More specifically, in this situation, the thermostat 134 activates both the burner 117 and the circulation blower 114 at the furnace 110. This causes room air to be drawn into the furnace is 110 and forced past the heat exchanger 116 where it is heated. The heated room air is then diverted through the indoor section 120 of the system 100. In this case (e.g., a call for heat), the thermostat 134 does not activate the compressor 224 or the fan 228 of system 100. Accordingly, there is no conditioning of the heated air as it flows through the indoor section 120. The heated air is then delivered to the various rooms of the house as described above.

It should be understood that auxiliary conduits 124, 128 and/or the indoor section 120 may be insulated to conserve energy.

It should be further understood that if the system 100 is not going to be used for an extended period of time (e.g., during the winter), the dam or baffle 132 may be removed and used to block the two holes leading to conduits 124, 128, thereby stopping the diversion of heated air through the indoor unit 120. That is, the dam 132 may sized (and/or may be adjustable) so as to cover both holes 126, 128 in the duct system 118 from the inside or the outside.

As shown, unlike the prior art air conditioners, the system 100 of the present invention does not require a separate fan or blower to be located adjacent to the evaporator coil 222. Instead, the system 100 uses the blower 114 that is part of the preexisting air moving system. Accordingly, system 100 is more economical to produce and can be smaller in size. In addition, the single, integrated support structure 202 of system 100, among other components, combines the indoor and outdoor units or sections 120, 122 into a single, unified package. This greatly facilitates installation of system 100 in both existing and new construction homes and buildings.

Preferably, the system is packaged and sold as a retro-fit kit for installation in a home or building already having an air moving system, such as a forced hot-air furnace. More specifically, a hole or cut is made to the exterior wall 102 of the home, preferably through skirt 108. The system 100 is then slid or passed through this hole until the intermediary wall 206 is generally aligned with exterior wall 102. Two holes are then formed in the air distribution duct system 118 at points 126 and 130 and the dam or wall 132 is inserted between them. The two auxiliary conduits 124, 128 leading from indoor section 120 are then connected to these two holes in the air distribution duct system 118. With the two units 120, 122 combined into a single package, there is no need to field install tubing and/or lines from an air conditioning compressor to an evaporator coil which may be physically separate from each other as in a conventional split system. Pigtails or other lines from the thermostat 134 are connected to the control circuit 242 or directly to compressor 224 and fan 228 and electrical power is supplied to the system 100. The furnace controller 115 may be modified (or replaced) as necessary so as to activate the circulation blower 114, but not the burner 117, in response to a call for air conditioning.

Significantly, the system 100 may be installed to almost any existing forced hot air furnace, in part because there is no need to raise the furnace. In fact, the system may be installed completely from outside the home or building assuming the ducts are accessible. Furthermore, with the evaporator positioned below the home (as with most manufactured home installations), any condensate that may be generated within the evaporator space will not enter the home, thereby avoiding water damage.

As best shown in FIG. 2, the two sections 120, 122 of system 100 are joined together in such a manner as to form a slot or "J-rail" 244 between the two sections 120, 122. The J-rail 244 preferably extends along at least three edges of the system 100 (i.e., the two sides and the top). This slot or J-rail 244 may be formed, at least in part, by making intermediary wall 206 neither as high nor as wide as the full height and width of the system 100 as shown by dimensions "H" for height and "W" for width. During installation of the system 100, the cut-out in the skirt or foundation 108 is sized to be received in the J-rail 242, thereby blocking outside air from blowing either into or underneath the home. That is, the cut-out preferably matches the smaller dimensions of intermediary wall 206 as opposed to the full height H and width W of the system 100.

Although the inlet to the first conduit 124 is preferably disposed directly below the furnace 110, it should be understood that it may be placed in other locations.

It should also be understood that the two conduits 124, 128 may terminate at other locations on the indoor section 120. For example, they could terminate at the top and bottom and/or at adjacent sides or the same side of unit 120.

It should be further understood that the system 100 may be installed in homes having a wide variety of differently designed air distribution duct systems, and that additional dams or baffles may be required depending on the configuration of the air distribution duct system to which the system 100 is being coupled.

Figure 4A:
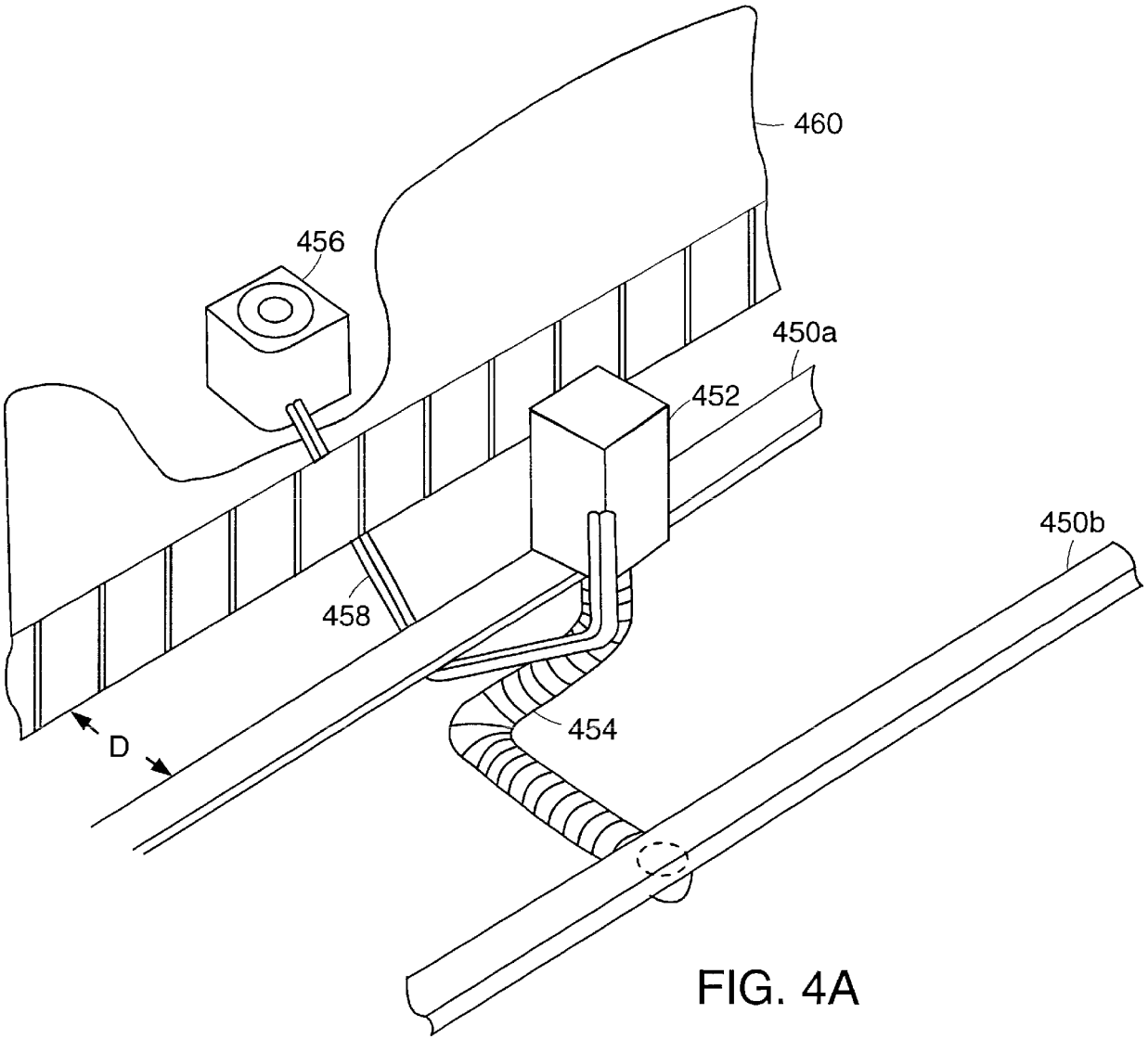
FIG. 4A is an isometric view of a conventional air conditioning/heat pump system installed in a home.

FIG. 4A is a partial view of a home in which a conventional air conditioning/heat pump (AC/HP) system is installed. The home includes two parallel duct lines or runs 450*a*, 450*b*. Mounted above a portion of one of the duct lines, e.g., line 450*a*, is a furnace 452. The two lines 450*a*, 450*b*, moreover, are interconnected by a cross-over duct 454. An air conditioning/heat pump (AC/HP) unit 456 is disposed outside of the home, but is connected to an evaporator coil (not shown) underneath the furnace 452 by copper tubing 458, which can be relatively lengthy. To provide efficient air distribution, the two duct lines 450*a*, 450*b* are spaced some horizontal distance, e.g. distance "D", from exterior walls, e.g., exterior wall 460. As a result, furnace 452 is also spaced distance "D" from exterior wall.

Figure 4B:
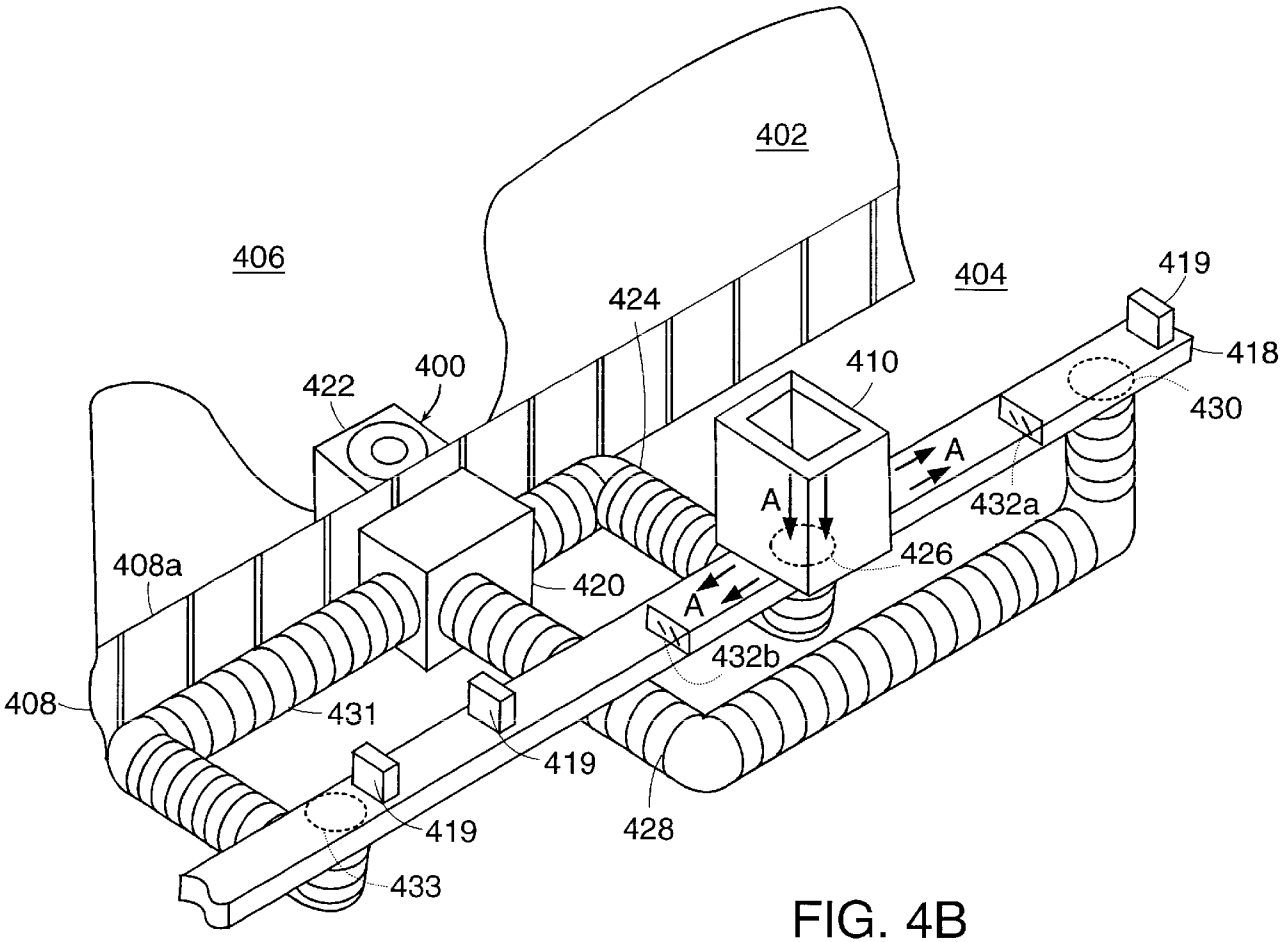
FIG. 4B is an isometric view generally of the home of FIG. 4A, but with the system of the present invention.

FIG. 4B is a partial view of the same home in which a blowerless air conditioning system 400 in accordance with the present invention, which is similar to system 100, has been installed. The home includes an exterior wall 402 defining an interior space 404 and an exterior space 406. The wall 402 includes a skirt or foundation 408 which extends along a lower portion thereof and has an upper edge 408*a* defining floor level. Within the interior 404 of the home is an air moving system such as a forced hot air furnace 410. Also located within the interior 404 of the home is an air moving system, such as an air distribution duct system 418. The air distribution duct system 418 may comprise a series of interconnected ducts and risers 419 leading to the various rooms of the home. The furnace 410 is preferably coupled to the air distribution duct system 418 so that room air drawn into the furnace 410 and heated may be distributed to the various rooms. As shown, the furnace 410 may be more centrally mounted to the air distribution duct system 418 as opposed to being mounted at an end as in the embodiment of FIG. 1.

The blowerless system 400 has an indoor section 420 and an outdoor section 422, and is preferably installed at exterior wall 402 so that outdoor section 422 is disposed in exterior space 406 (e.g., outside the home or building), while the indoor section 420 is disposed within the interior space 404 (e.g., inside) or preferably underneath the home or building as defined by floor level 408*a*. A first auxiliary conduit or inlet 424 preferably couples the indoor section 420 to a first point 426 of the air distribution duct system 418. A second auxiliary conduit or outlet 428 couples the indoor section 420 to a second point 430, while a third auxiliary conduit or outlet 431 couples the indoor section 420 to yet a third point 433 of the air distribution duct system 418. Both the second and third connection points 430, 433 are located downstream from the first connection point 426 relative to the air flow direction as shown by arrows A. In this embodiment, there are two dams or baffles 432*a* and 432*b* disposed within the air distribution duct system 418. Baffle 432*a* is disposed between connection points 426 and 430, while baffle 432*b* is disposed between connection points 426 and 433. Each dam or baffle 432*a*, 432*b* is preferably a solid panel that blocks air from flowing through duct system 418 between the respective connection points.

In operation, air from furnace 410 flows through auxiliary conduit 424 and enters the indoor section 420 of system 400 where it is conditioned, e.g., cooled and/or dehumidified. Air exits indoor section 420 through both auxiliary conduit 428 and 431. Conditioned air is thus supplied to the air distribution duct system 418 at points 430 and 433. From here, the conditioned air flows through the duct system 418 and enters the various rooms of the home. Due to the installation of baffles 432*a*, 432*b*, conditioned air is blocked from simply recirculating through the indoor section 420.

The arrangement of FIG. 4B provides for improved flow of conditioned air through the home as compared to the prior art systems which would typically provide conditioned air to only a single point in the duct system 418. The system 400 of the present invention also allows a far greater flexibility in installation locations as compared to the prior art systems.

Those skilled in the art will recognize that three or more dams or baffles may be required in some installations.

Figure 4C:
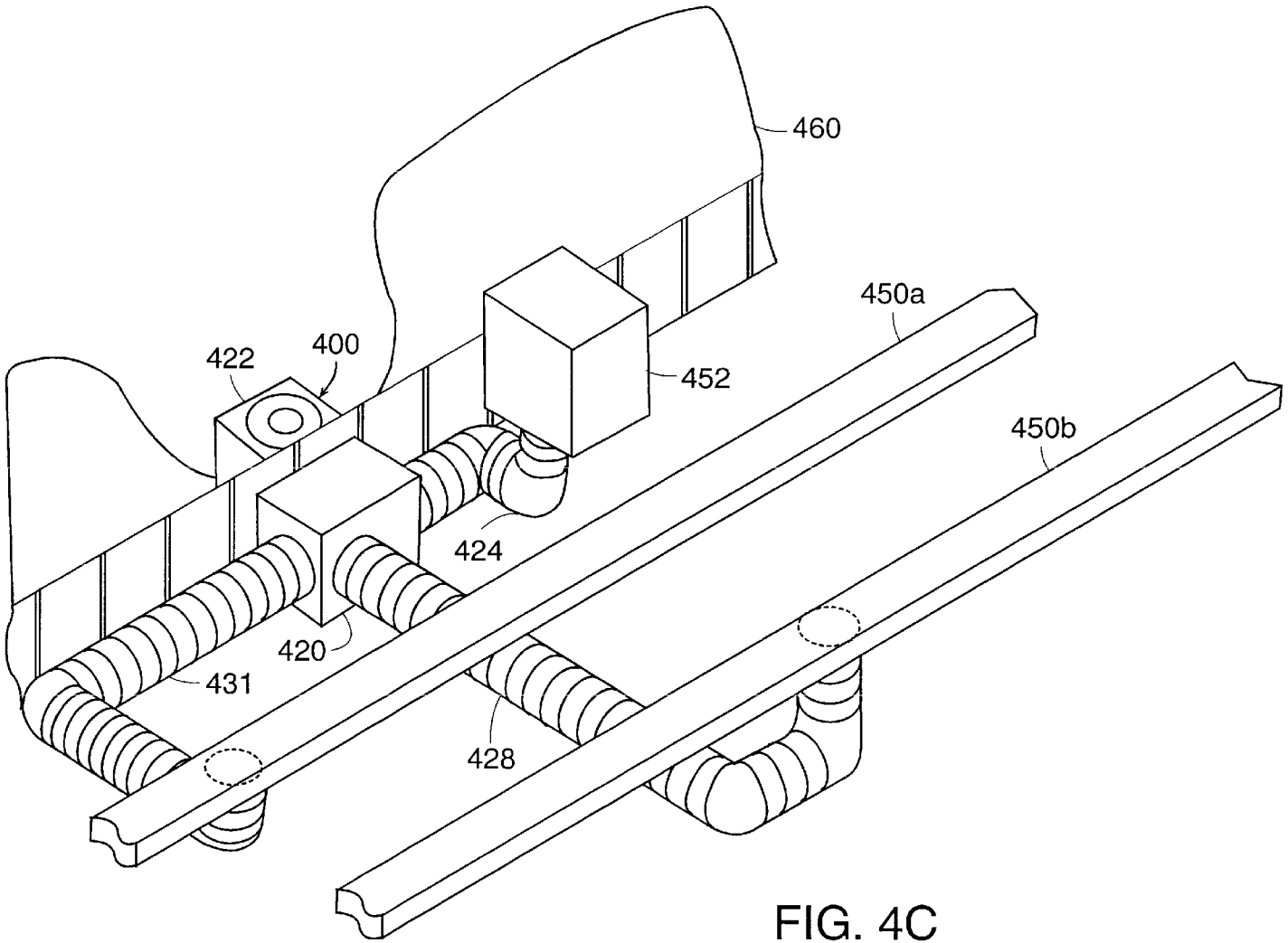
FIG. 4C is an isometric view of a home specially designed for the system of the present invention.

FIG. 4C is a partial view of a home which has been specially designed to use the system of the present invention. FIG. 4C has similar reference numerals as FIGS. 4A and 4B. In this home, the furnace 452 does not need to be placed on a duct line 450*a* or 450*b* and no dams are required. Since the furnace 452 can be moved off the duct line 450*a*, it may be placed close to the exterior wall 460, near the electrical distribution box (not shown) and in a way to save space in the home.

Figure 5:
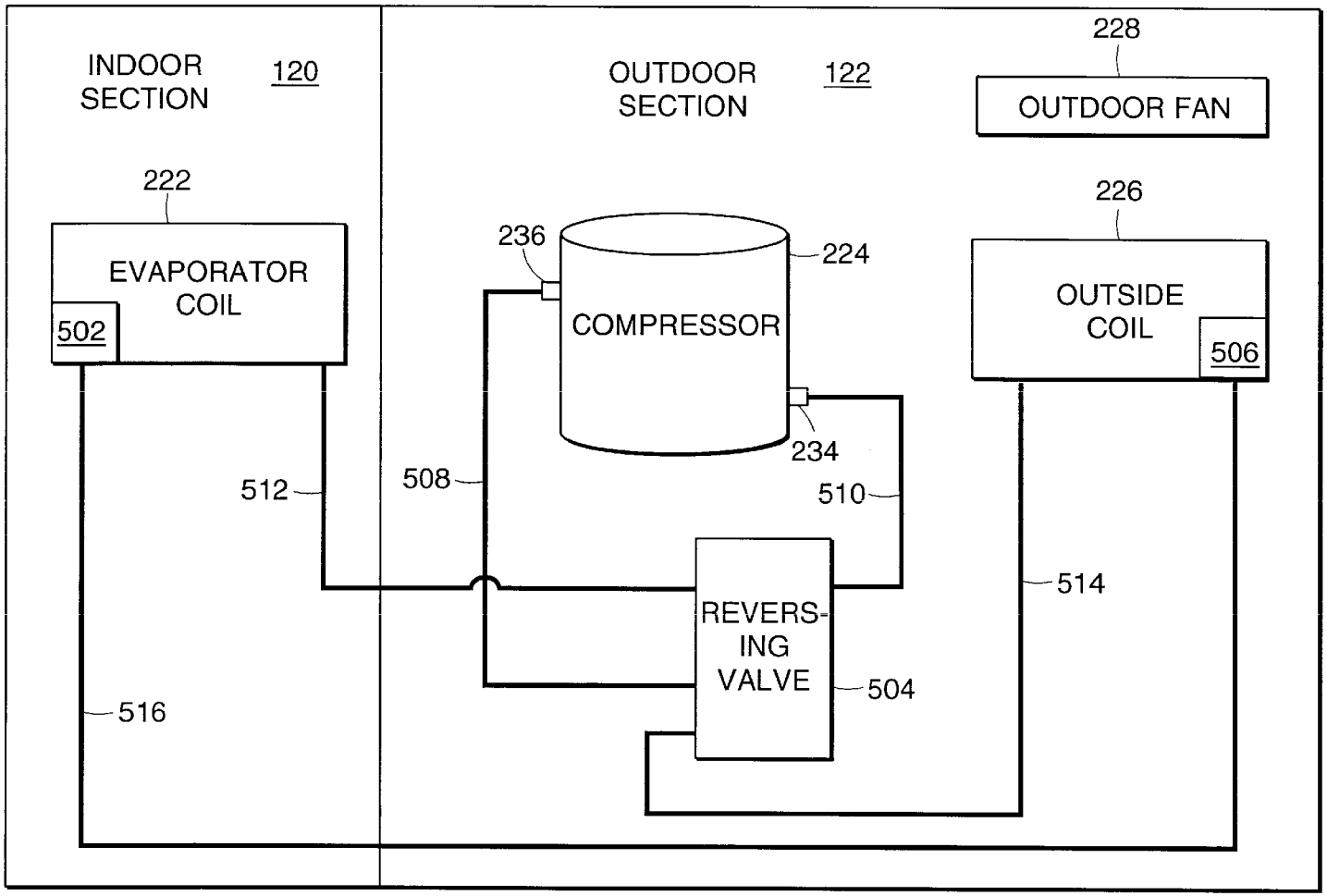
FIG. 5 is a highly schematic block diagram of the system of the present invention configured as a heat pump.

FIG. 5 is a highly schematic, functional block diagram of the system 100 of the present invention configured to operate as a heat pump. As described above, the system 100 includes an indoor section 120 and an outdoor section 122. Within the indoor section 120 is an evaporator coil 222 that includes an expansion or metering device 502. Within the outdoor section 122 is a compressor 224, an outdoor coil 226 and an outdoor fan 228. The compressor 224 has an inlet 236 and an outlet 234. When configured as a heat pump, the system 100 further includes a reversing valve 504. In addition, an expansion or metering device 506 is added to the outdoor coil 226 as well. The inlet and outlet 236, 234 of the compressor 224 are coupled to the reversing valve 504 by lines 508, 510 and the two coils 222, 226 are coupled to reversing valve 504 by lines 512, 514 and to each other by line 516.

For cooling, the reversing valve 504 is set so that hot, high pressure refrigerant from compressor outlet 234 is directed to outside coil 226. Cooled, liquefied refrigerant then exits outside coil 226, by-passing one-way metering device 506 and enters evaporator coil 222 via line 516 and metering device 502 at evaporator coil 222. Room air is forced past the evaporator coil 222 cooling it as described above. The reversing valve 504 is further set during cooling so that evaporated refrigerant from evaporator coil 222 is directed via lines 512 and 508 to the compressor inlet 236.

For heating, the flow path is basically reversed. In particular, the reversing valve 504 is set so that hot, high pressure refrigerant from compressor outlet 234 is directed to evaporator coil 222 via lines 510 and 512. That is, reversing valve 504 effectively couples these two lines 510, 512 together. Refrigerant cools and liquefies within the evaporator coil 222 thereby heating the room air being forced past the evaporator coil 222 by the furnace blower. Liquid refrigerant exits the evaporator coil 222, by-passing one-way metering device 502, and enters the outside coil 226 via line 516 and metering device 506. Here, the refrigerant evaporates absorbing heat from the outdoor air being forced through the outside coil 226 by outdoor fan 228. The reversing valve 504 is further set during heating so that evaporated refrigerant from outdoor coil 226 is directed via lines 514 and 508 to the compressor inlet 236.

The foregoing description has been directed to specific embodiments of this invention. It will be apparent, however, that other variations and modifications may be made to the described embodiments, with the attainment of some or all of their advantages. For example, rather than using a dam in the air distribution duct system, the air distribution duct system may be reworked (e.g., split or cut and new ducts installed) to lead directly from the furnace to the indoor section and from the indoor section to the various rooms of the home or building to be cooled. Therefore, it is an object of the appended claims to cover all such variations and modifications as come within the true spirit and scope of the invention.

What is claimed is:

1. An air conditioner kit for retro-fitting an existing air moving system coupled to an air distribution duct system, the air moving system configured and arranged to force air through the air distribution duct system, the air conditioner kit comprising:

a support structure;

an indoor section mounted to a first part of the support structure, the indoor section including an evaporator coil, but devoid of a fan;

an outdoor section mounted to a second part of the support structure, the outdoor section including an outdoor coil, and a fan configured and arranged to move air past the outdoor coil;

a compressor for operating on a refrigeration fluid;

means for connecting the evaporator coil and the outdoor coil to the compressor, the connecting means permitting the refrigeration fluid to flow between and among the evaporator coil, the compressor and the outdoor coil; and means for connecting the indoor section to the air distribution duct system so that air is diverted through the indoor section.

2. The air conditioner kit of claim 1 further comprising one or more dams configured for mounting within the air distribution duct system so as to divert air through the indoor section.

3. The air conditioner kit of claim 2 wherein the indoor section is connected to the air distribution duct system at two or more points, a first point being upstream of at least one dam relative to the air moving system and a second point being downstream of the at least one dam.

4. The air conditioner kit of claim 1 wherein the connecting means comprises at least two holes, each hole configured and arranged to receive a respective auxiliary conduit extending from the air distribution duct system.

5. The air conditioning kit of claim 4 further comprising a dam configured for mounting within the air distribution duct system between the at least two auxiliary conduits so as to divert air through the indoor section.

6. The air conditioning kit of claim 4 wherein the air moving system is a furnace having a circulation blower and a source of heat, a thermostat is coupled to the furnace and the air conditioning kit, and the thermostat is configured, in response to a call for air conditioning, to activate the compressor and the fan of the air conditioning kit and the circulation blower, but not the heat source of the furnace.

7. The air conditioning kit of claim 6 wherein the thermostat is further configured, in response to a call for heat, to activate the circulation blower and the heat source of the furnace, but neither the compressor nor the fan of the air conditioning kit.

8. The air conditioning kit of claim 1 further comprising a receiving slot formed between the indoor and outdoor sections, the receiving slot configured to receive an edge of a skirt thereby sealing the indoor section and blocking outside air from blowing under the home.

9. A method for retro-fitting a home that includes an existing air moving system for forcing air through an air distribution duct system, the method comprising the steps of:

providing an air conditioner kit comprising:

a support structure;

an indoor section mounted to a first part of the support structure, the indoor section including an evaporator coil, but devoid of a fan;

an outdoor section mounted to a second part of the support structure, the outdoor section including an outdoor coil, and a fan configured and arranged to move air past the outdoor coil;

a compressor for operating on a refrigeration fluid;

means for connecting the evaporator coil and the outdoor coil to the compressor, the connecting means permitting the refrigeration fluid to flow between and among the evaporator coil, the compressor and the outdoor coil; and means for connecting the indoor section to the air distribution duct system so that air is diverted through the indoor section;

installing the air conditioner kit to the home so that the outdoor section is disposed outside of the home and the indoor section is disposed one of inside and below the home; and connecting the indoor section to the air distribution duct system so that air under operation of the air moving system is diverted through the indoor section before flowing through at least part of the air distribution duct system.

10. The method of claim 9 further comprising the steps of:

installing at least one dam within the air distribution duct system;

connecting the indoor section to the air distribution duct system at a first point located upstream of the at least one dam relative to the air moving system; and connecting the indoor section to the air distribution duct system at a second point located downstream of the at least one dam, thereby diverting air through the indoor section.

11. The method of claim 10 wherein the air moving system is a furnace having a circulation blower and a heat source and the home includes a thermostat connected to the furnace, the method further comprising the step of connecting the thermostat to the air conditioning kit, so that the thermostat, in response to a call for air conditioning, activates the compressor and the fan of the air conditioning kit, and the circulation blower, but not the heat source of the furnace.

12. An air conditioning system comprising:

a support structure having an intermediary wall dividing the support structure into first and second parts;

a generally enclosed indoor section mounted to the first part of the support structure, the indoor section including an evaporator coil, but devoid of a fan;

an outdoor section mounted to the second part of the support structure, the outdoor section including a fan and an outdoor coil;

a compressor for operating on a refrigeration fluid;

one or more tubes connecting the evaporator coil and the outdoor coil to the compressor, the one or more tubes permitting the refrigeration fluid to flow between and among the evaporator coil, the compressor and the outdoor coil; and at least two holes formed in the generally enclosed indoor section, the at least two holes configured to direct air that is to be conditioned to flow past the evaporator coil.

13. The air conditioning system of claim 12 wherein the support structure includes a base and an intermediary wall disposed between the first and second parts.

14. The air conditioning system of claim 12 for use in a home having an air distribution duct system and an air moving system coupled to the air distribution duct system, the system further comprising:

a first conduit providing fluid communication between a first point in the air distribution duct system and the indoor section;

a second conduit providing fluid communication between a second point in the air distribution duct system and the indoor section, the second point downstream of the first point relative to air moving system; and one or more dams disposed in the air distribution duct system between the first and second points.

15. The air conditioning system of claim 14 wherein the air moving system includes a circulation blower and a heat source, in response to a call for air conditioning, the circulation blower, but not the heat source, is activated.

16. The air conditioning system of claim 15 wherein, in response to a call for air conditioning, the compressor and the fan of the conditioning system are activated.

17. A heat pump for connecting to an air moving system coupled to an air distribution duct system, the air moving system configured and arranged to force air through the air distribution duct system, the heat pump comprising:

a support structure;

an indoor section mounted to a first part of the support structure, the indoor section including an evaporator coil, but devoid of a fan;

an outdoor section mounted to a second part of the support structure, the outdoor section including an outdoor coil, and a fan configured and arranged to move air past the outdoor coil;

a compressor for operating on a refrigeration fluid;

means for connecting the evaporator coil and the outdoor coil to the compressor, the connecting means permitting the refrigeration fluid to flow between and among the evaporator coil, the compressor and the outdoor coil; and means for connecting the indoor section to the air distribution duct system so that air is diverted through the indoor section.

18. The heat pump of claim 17 further comprising a reversing valve coupled to the means for connecting the evaporator coil and the outdoor coil to the compressor, the reversing valve configured to selectively reverse the direction of flow of the refrigeration fluid so as to generate one of heating and cooling.

19. The heat pump of claim 18 wherein the evaporator coil further includes an expansion device, and the outdoor coil further includes an expansion device.

20. The heat pump of claim 19 further comprising one or more dams configured for mounting within the air distribution duct system so as to divert air through the indoor section.

21. The heat pump of claim 20 wherein the indoor section is connected to the air distribution duct system at two or more points, a first point being upstream of at least one dam relative to the air moving system and a second point being downstream of the at least one dam.

22. The heat pump of claim 21 wherein the support structure includes a base and an intermediary wall disposed between the first and second parts.

23. The heat pump of claim 22 wherein the air moving system includes a circulation blower, and in response to a call for air conditioning, the circulation blower is activated.

24. The heat pump of claim 23 wherein, in response to a call for air conditioning or for heating, the compressor and the fan are activated and the reversing valve is moved to the appropriate position.

25. A method for retro-fitting a home that includes an existing air moving system for forcing air through an air distribution duct system, the method comprising the steps of:

providing a heat pump comprising:

a support structure;

an indoor section mounted to a first part of the support structure, the indoor section including an evaporator coil, but devoid of a fan;

an outdoor section mounted to a second part of the support structure, the outdoor section including an outdoor coil, and a fan configured and arranged to move air past the outdoor coil;

a compressor for operating on a refrigeration fluid;

means for connecting the evaporator coil and the outdoor coil to the compressor, the connecting means permitting the refrigeration fluid to flow between and among the evaporator coil, the compressor and the outdoor coil; and means for connecting the indoor section to the air distribution duct system so that air is diverted through the indoor section;

installing the heat pump kit to the home so that the outdoor section is disposed outside of the home and the indoor section is disposed one of inside and below the home;

connecting the indoor section to the air distribution duct system so that air under operation of the air moving system is diverted through the indoor section before flowing through at least part of the air distribution duct system.

26. The method of claim 25 further comprising the steps of:

installing at least one dam within the air distribution duct system;

connecting the indoor section to the air distribution duct system at a first point located upstream of the at least one dam relative to the air moving system; and connecting the indoor section to the air distribution duct system at a second point located downstream of the at least one dam, thereby diverting air through the indoor section.

27. The method of claim 26 further comprising the step of providing a receiving slot between the indoor and outdoor sections, and wherein the step of installing the heat pump comprises the step of fitting an edge of a skirt within the receiving slot thereby sealing the indoor section and blocking outside air from blowing under the home.

* * * * *